US006544111B1

(12) United States Patent
Kimura et al.

(10) Patent No.: US 6,544,111 B1
(45) Date of Patent: Apr. 8, 2003

(54) POLISHING APPARATUS AND POLISHING TABLE THEREFOR

(75) Inventors: Norio Kimura, Fujisawa (JP); Yu Ishii, Yokohama (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/485,862

(22) PCT Filed: Feb. 1, 1999

(86) PCT No.: PCT/JP99/00410

§ 371 (c)(1),
(2), (4) Date: Feb. 17, 2000

(87) PCT Pub. No.: WO99/38651

PCT Pub. Date: Aug. 5, 1999

(30) Foreign Application Priority Data

Jan. 30, 1998 (JP) ..... 10-034348

(51) Int. Cl.[7] ..... B24B 7/22
(52) U.S. Cl. ..... 451/288; 451/7
(58) Field of Search ..... 451/41, 449, 288, 451/53, 7

(56) References Cited

U.S. PATENT DOCUMENTS 4,471,579 A 9/1984 Bovensiepen
5,036,630 A * 8/1991 Kaanta et al. ..... 451/41
5,400,547 A * 3/1995 Tanaka et al. ..... 451/287
5,658,183 A 8/1997 Sandhu et al.
5,873,769 A * 2/1999 Chiou et al. ..... 451/7
6,095,898 A * 5/2000 Hennhofer et al. ..... 451/53

FOREIGN PATENT DOCUMENTS

JP 9-290365 11/1997
JP 11-42551 2/1999
JP 11-347935 12/1999

OTHER PUBLICATIONS

Patent abstracts of Japan, JP 61265262 published Nov. 25, 1986.

* cited by examiner

*Primary Examiner*—Robert A. Rose
(74) *Attorney, Agent, or Firm*—Wenderoth, Lind & Ponack, L.L.P.

(57) ABSTRACT

A polishing apparatus can strictly control the degree of material removal by providing close control over the operating temperature in the polishing table (12). The polishing apparatus has a polishing table (12) and a workpiece holder (14) for pressing a workpiece (W) towards the polishing table (12). The polishing table (12) has a polishing section (30) or a polishing tool attachment section at a surface thereof and a thermal medium passage (32) formed along the surface. The thermal medium passage (32) has a plurality of temperature adjustment passages provided respectively in a plurality of temperature adjustment regions which are formed by radially dividing a surface area of the polishing table (12).

10 Claims, 10 Drawing Sheets

PRIOR ART

PRIOR ART

POLISHING APPARATUS AND POLISHING TABLE THEREFOR

TECHNICAL FIELD

The present invention relates to polishing apparatuses, and relates in particular to a polishing table for providing a flat and mirror polished surface on a workpiece such as semiconductor wafer.

BACKGROUND ART

Advances in integrated circuit devices in recent years have been made possible by ultra fine wiring patterns and narrow interline spacing. The trend towards high density integration leads to a requirement of extreme flatness of substrate surface to satisfy the shallow depth of focus of a stepper in photolithographic reproduction of micro-circuit patterns. A flat surface can be obtained on semiconductor wafer by chemical-mechanical polishing using a polishing table and a wafer carrier to press the wafer surface on a polishing cloth mounted on the polishing table while supplying a polishing solution containing abrasive particles at the polishing interface.

An example of the conventional polishing apparatus is shown in FIG. 9. A polishing table 12 capped with a polishing cloth 10 is used in conjunction with a top ring (wafer carrier) 14 for holding and pressing the wafer W onto the rotating top ring 14 with an air cylinder. Polishing solution Q is supplied from a solution nozzle 16, and the solution is retained in the interface between the cloth 10 and the bottom surface of the wafer W to be polished.

In such a polishing apparatus, heat is generated by friction between the wafer W and the cloth 10, and a pair of the heat is carried by the polishing solution while the remainder is transferred to the top ring 14 and the polishing table 12 and is removed by a cooling mechanism provided in these devices. A structural configuration of the polishing table 12 is shown in FIG. 10, which shows that the circular interior of the polishing table 12, made of stainless steel, has a spiral fluid passage 18 for flowing a thermal medium supplied through concentric shaft passages 22, 24 formed in the interior of a shaft 20. A rotary coupling is used to transport the thermal fluid from an external source through the passages 22, 24.

In chemical-mechanical polishing in general, and especially when using an acidic or alkaline solution, the rate of material removal is dependent sensitively on the temperature at the polishing interface. Therefore, in order to improve the uniformity of material removal across the surface of the wafer W, it is desired to control the polishing temperature distribution uniformly or in accordance with a predetermined temperature distribution pattern by controlling the flow rate of the fluid medium flowing through the spiral fluid passage 18 in the polishing table 12.

However, because the polishing table 12 is made of stainless steel in the conventional polishing apparatus, thermal conductivity is low, and it has been difficult to control the temperature of the polishing table 12 to provide the desired degree of thermal response characteristics. Also, the simplistic unidirectional flow pattern of the thermal fluid passage 18 results in a time lag for transferring heat between the center region and the outer region of the polishing table 12, and presents a problem that the polishing table 12 is unable to control individual temperatures of different regions of the turntable that are subjected to different polishing conditions.

SUMMARY OF THE INVENTION

It is an object of the present invention to provide a polishing apparatus able to strictly control the degree of material removal by providing close control over the operating temperature in the polishing table.

The object has been achieved in a polishing apparatus comprising a polishing table and a workpiece holder for pressing a workpiece towards the polishing table, the polishing table having a polishing section or a polishing tool attachment section at a surface thereof and a thermal medium passage formed along the surface, wherein the thermal medium passage comprises a plurality of temperature adjustment passages provided respectively in a plurality of temperature adjustment regions which are formed by radially dividing a surface area of the polishing table.

Accordingly, the lengths of individual passages are shortened so that the thermal medium passes through the passages quickly without experiencing much temperature variation, thereby stabilizing the polishing interface temperature and enabling the quick reflection of temperature control changes to the actual table temperatures to improve startup time and responsiveness of the polishing system. Also, because the flow of the thermal medium can be controlled for individual regions of the polishing table, finely-tuned temperature control can be performed to suit local changes encountered in the various regions of the polishing table.

The thermal medium passages may include two temperature adjustment passages extending from a mid-radially disposed fluid entry port, such that one passage extends to a center of the polishing table while other passage extends to a periphery of the polishing table.

Accordingly, since the passage is divided into two sections of shorter lengths, the time required for the thermal medium to pass through the passages is lessened, thereby enabling the quick reflection of temperature control changes to the actual table temperatures to improve startup time and responsiveness of the polishing system. Also, because the thermal medium flows into the region of the table where polishing is performed, temperature control of the workpiece can be achieved quickly.

The apparatus may be provided with flow adjustment valves for individually controlling fluid flow rates in the temperature adjustment passages.

The apparatus may be provided with temperature adjustment means for individually controlling temperatures of thermal media to be supplied to the temperature adjustment passages.

The apparatus may also be provided with sensor means for measuring temperatures in various locations of the surface region and flow control means for controlling individual flow rates of thermal media flowing in the temperature adjustment passages.

In another aspect of the invention, a polishing apparatus comprises a polishing table and a workpiece holder for pressing a workpiece towards the polishing table, the polishing table having a polishing section or a polishing tool attachment section at a surface thereof and a thermal medium passage formed along the surface, wherein at least the surface region of the polishing table is made of a material of high thermal conductivity. Preferred materials include SiC which has a thermal conductivity higher than 0.06 cal/cm/s/° C.

In another aspect of the invention, a polishing table has a polishing section or a polishing tool attachment section at a surface thereof and a thermal medium passage formed along the surface, wherein the thermal medium passage comprises a plurality of temperature adjustment passages provided respectively in a plurality of temperature adjustment regions which are formed by radially dividing a surface area of the polishing table.

In the present polishing apparatus, because individual flow rates in various regions of the polishing table can be controlled, finely-tuned temperature control can be carried out to suit variations and changes in local polishing conditions. Temperature control is further enhanced by selecting a material of high thermal conductivity for at least those parts associated with the surface region. Heat transfer rate from the thermal passages to the surface region is facilitated so that thermal lag time is reduced and responsive temperature control can be achieved. Therefore, the present polishing system provides superior polishing in a variety of situations, thereby presenting an important technology for manufacturing of highly integrated semiconductor devices.

BEST MODE FOR CARRYING OUT THE INVENTION

Figure 1:
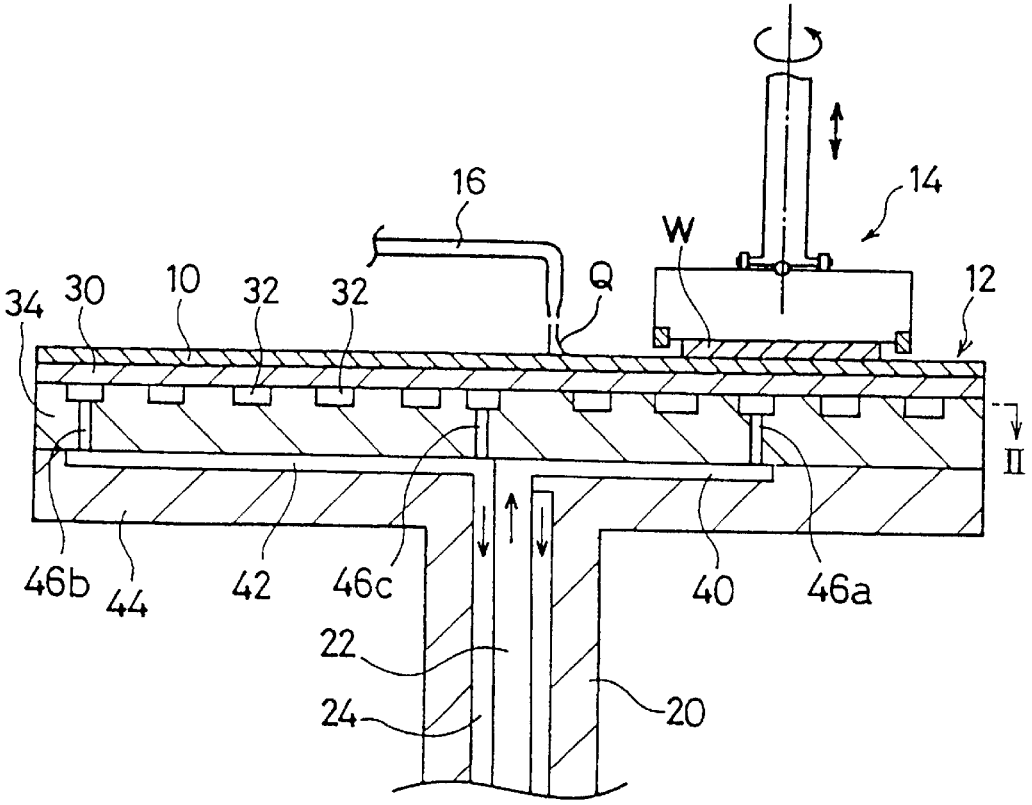
FIG. 1 is a schematic cross sectional view of a polishing table in a first embodiment.
Figure 2:
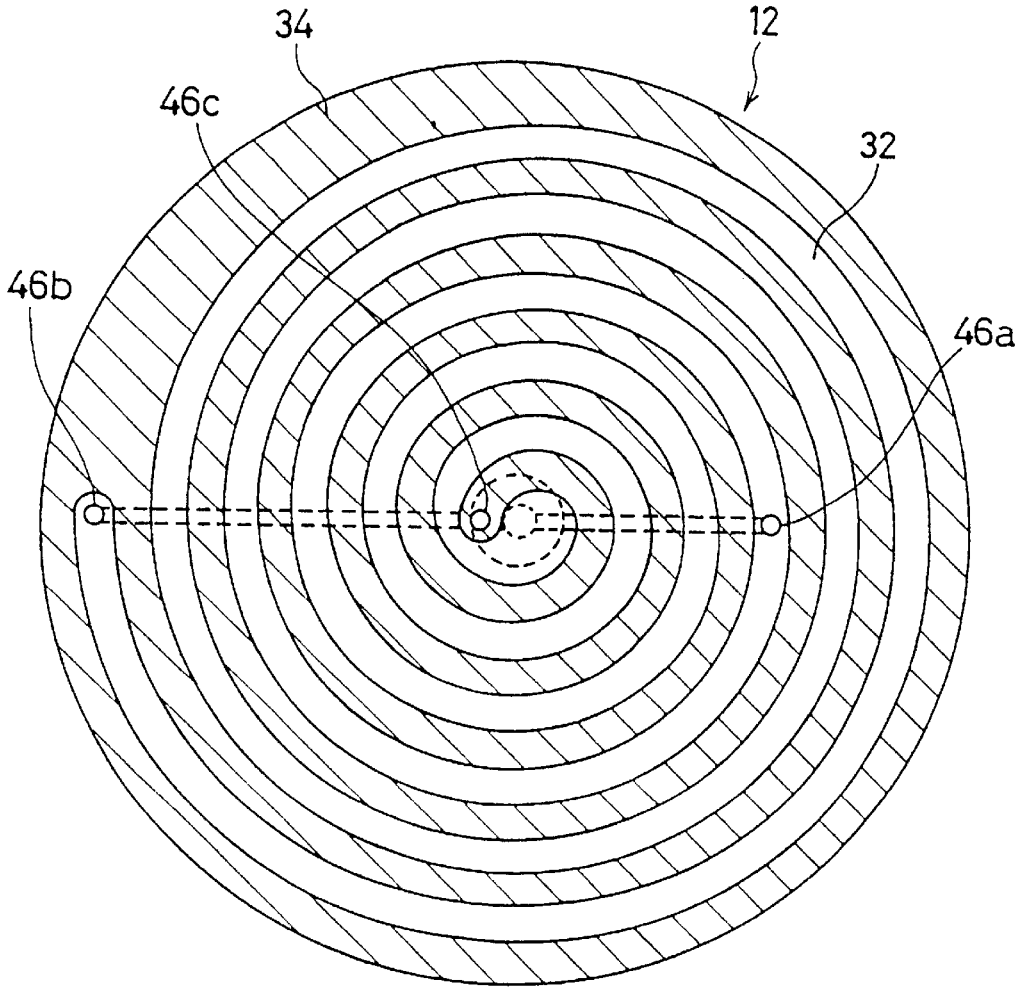
FIG. 2 is a perspective view through a section II in FIG. 1.
Figure 3:
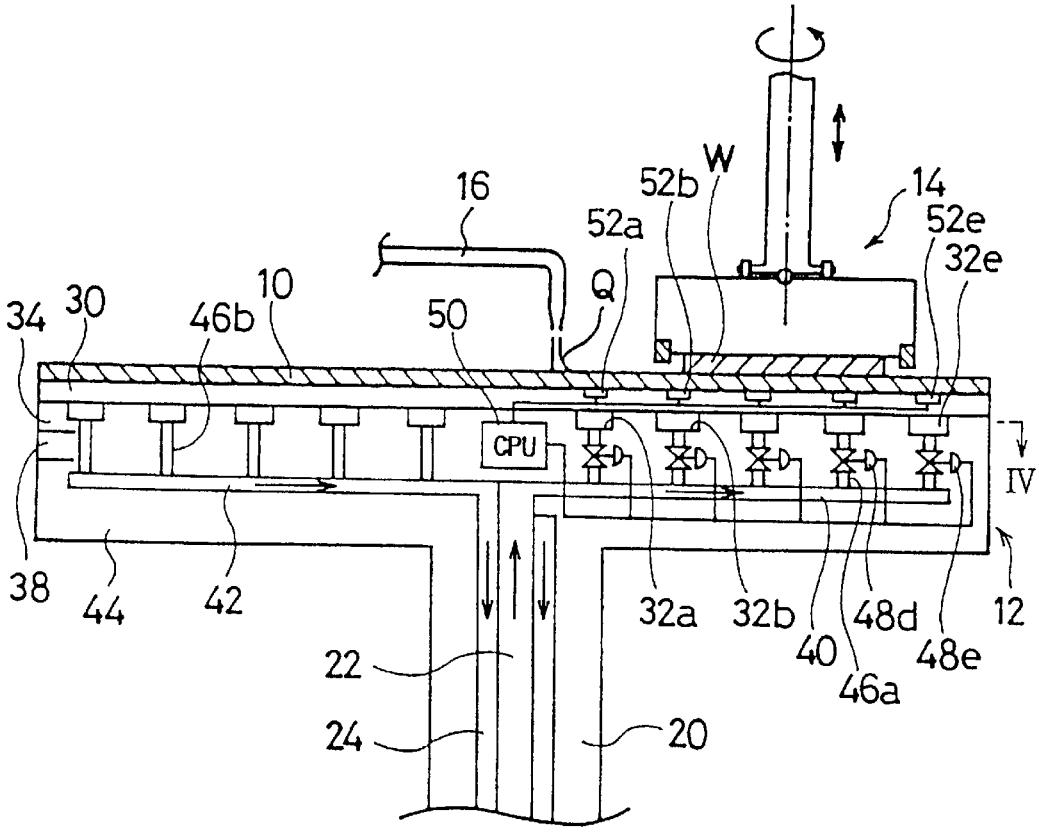
FIG. 3 is a schematic cross sectional view of a polishing table in a second embodiment.
Figure 4:
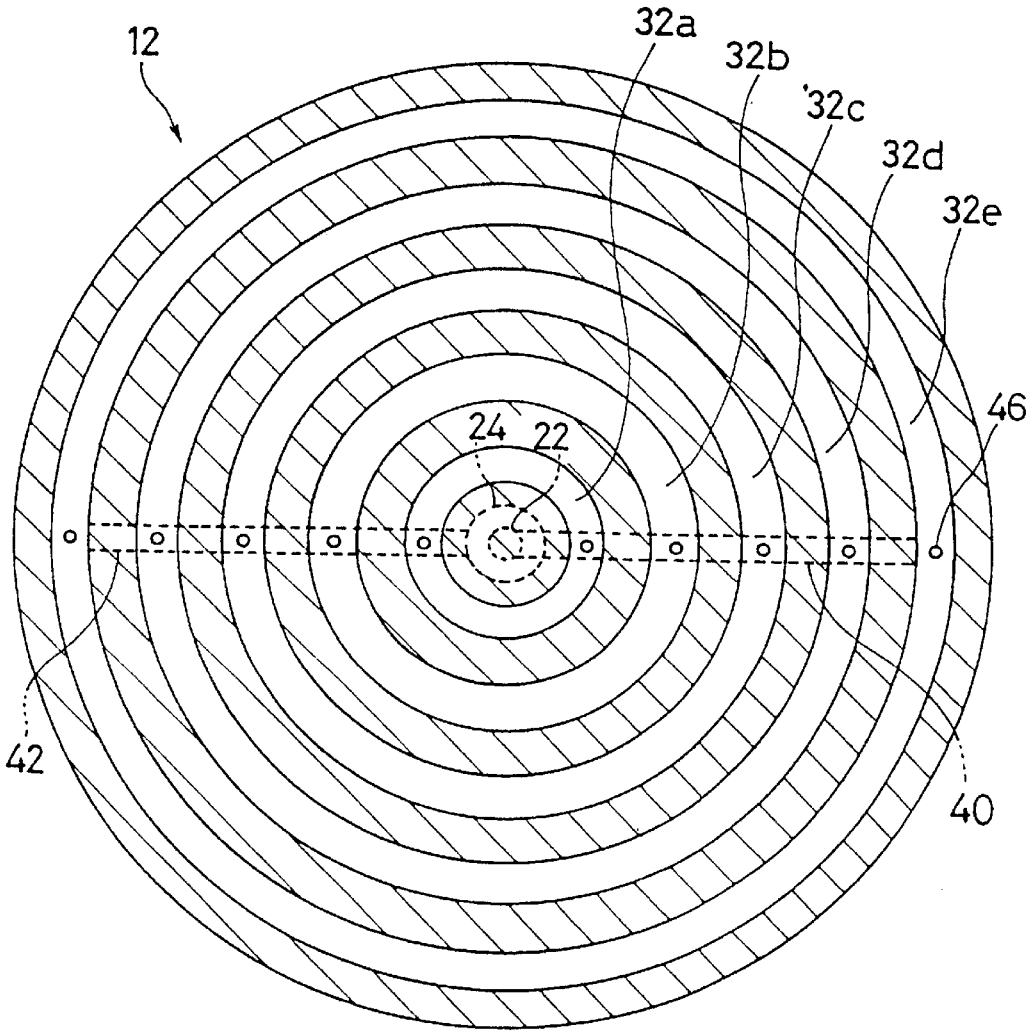
FIG. 4 is a perspective view through a section IV in FIG. 3.

In the following, the first embodiment according to the present invention will be presented with reference to FIGS. 1 and 2. Polishing table 12 comprises an upper plate 30 having a polishing cloth 10 mounted on top, a second plate 34 having a spiral-shaped temperature adjustment fluid passage 32 formed on a top surface region, and a lower plate 44 having incoming and outgoing thermal medium supply passages 40, 42 extending radially and communicating respectively with concentric fluid passages 22, 24. The second plate 34 is provided with three connecting passages 46*a*, 46*b* and 46*c* for communicating the temperature adjustment fluid passage 32 with the incoming and outgoing supply passages 40, 42 of the lower plate 44.

An incoming connecting passage 46*a* meets the spiral-shaped temperature adjustment fluid passage 32 at about the radial mid-point between the center and periphery of the polishing table 12. That is, the opening of the incoming connecting passage 46*a* is located below the polishing table 12 to correspond with the location of the workpiece W, as illustrated in FIG. 1. Outgoing connecting passage 46*b* is connected to the outside end of the passage 32, and outgoing connecting passage 46*c* is connected to the inside end of the temperature adjustment fluid passage 32 of the polishing table 12.

Therefore, an internal thermal medium passage is formed in the polishing table 12 so that the thermal medium flows out from the outlet of the inner concentric fluid passage 22 radially along the incoming supply passage 40 in the lower plate 44, and then flows through the incoming connecting passage 46*a* of the second plate 34 to flow into the temperature adjustment fluid passage 32. Then, the thermal medium flows through the temperature adjustment fluid passage 32 to branch into inward and outward directions. Inward and outward flows reach the inside and outside ends of the temperature adjustment passage 32 and go forward through outgoing connecting passages 46*c*, 46*b*, respectively, into the outgoing supply passage 42 to return through the outer concentric passage 24.

In the polishing table 12 of such a construction, temperature adjustment passage 32 is divided into two sections, and the individual passage is made short so that the circulation time for the thermal medium is shortened. Therefore, the time necessary for starting up the polishing operation can be shortened, and a quick response in temperature change for controlling operation can be achieved. Also, because the opening of the passage is located opposite to the workpiece W in this embodiment, an advantage is that rapid temperature control at the most critical region of the workpiece can be achieved efficiently.

In addition to the features presented above, the surface temperature of the upper plate 30 can be made uniform by maintaining a constant flow rate of thermal medium per unit area of the upper plate. To achieve this objective, the cross sectional area of the fluid passage may be varied on the outside passage (draining through 46*b*) and on the inside passage (draining through 46*c*) of the temperature adjustment passage 32 so as to achieve a constant flow rate in each case. It is also possible to adjust the flow rates by providing a suitable flow adjusting valve in the outgoing connecting passages 46*b* and 46*c* so as to produce a constant flow rate per unit area of the upper fixed plate 30.

It is also possible to provide a thermal insulation cover for the bottom surface of the lower plate 44 for preventing heat radiation therefrom to facilitate temperature control of the upper plate 30, so that thermal response time lag is decreased to achieve even more improved temperature control. in the upper plate 30.

It should be noted that although the thermal fluid is supplied from one entry port and drained through two exit polls in the foregoing embodiment, it is also permissible to arrange a plurality of entry pols and drainage through a common outlet to provide a plurality of temperature adjustment passages so as to obtain similar thermal control effects.

Figure 5:
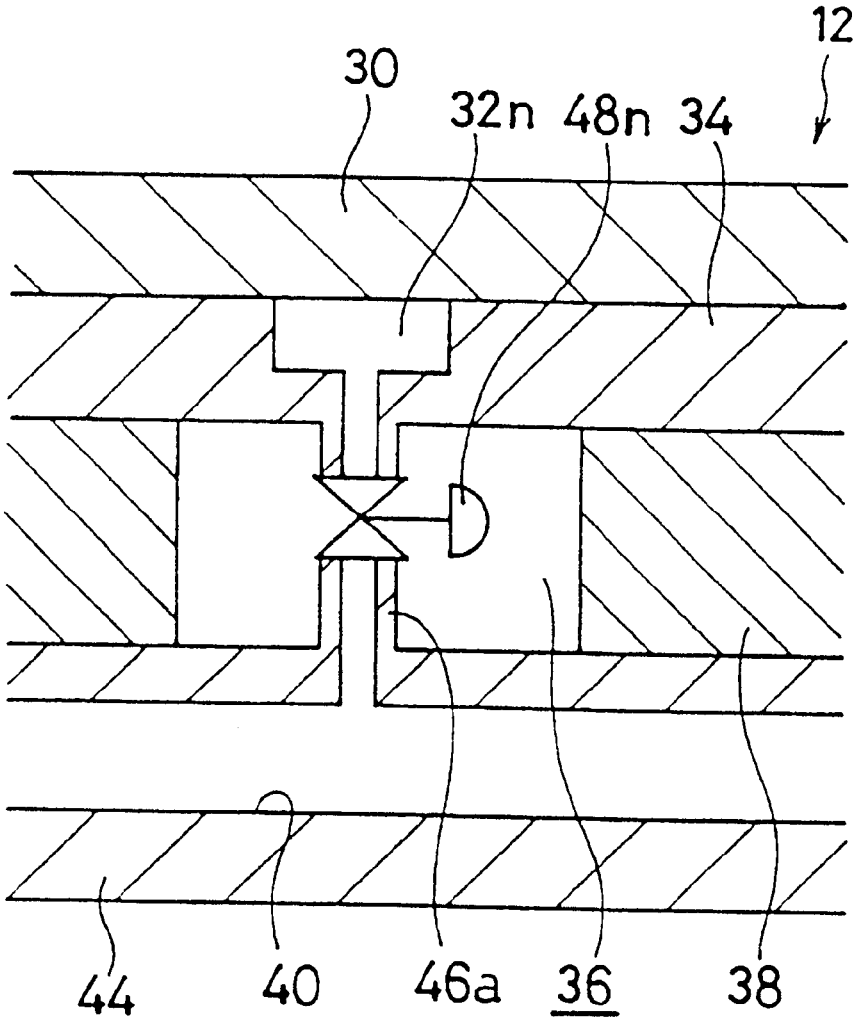
FIG. 5 is an enlarged cross sectional view of an essential section in FIG. 3.

The second embodiment will be presented in the following with reference to FIGS. 3 to 6. The polishing table 12, in this embodiment comprises an upper plate 30 having a polishing cloth 10 mounted on top, a second plate 34 having a plurality (five shown in FIG. 3) of circular groove-shaped temperature adjustment fluid passages 32*a*, 32*b*, 32*c*, 32*d*, 32*e* formed on the top surface, a third plate 38 having a space 36 formed at certain locations, and a lower plate 44 having incoming and outgoing thermal medium supply passages 40,42 extending radially and communicating with the concentric fluid passages 22, 24. As shown in FIG. 5, the space 36 within the third plate 38 is provided for the purpose of accommodating incoming and outgoing connecting pipes 46*a*, 46*b* for communicating the thermal fluid passages of second and lower plates 34, 44. Flow adjusting valves 48*a*, 48*b*, 48*c*, 48*d*, 48*e* are provided on the incoming connecting pipes 46*a* and have associated drive mechanisms, as well as a control unit (CPU) 50 and associated devices, which will be explained later.

In this polishing apparatus, the thermal fluid passage is arranged so that thermal fluid flows as follows. Fluid enters into the lower plate 44 from the concentric center passage 22 and flows radially along the incoming supply passage 40 until it reaches the respective intersecting points with the temperature adjustment passages 32*a*, 32*b*, 32*c*, 32*d*, $3^2$e, and then flows further upwards through respective incoming connecting pipes 46*a*, and then enters and flows half-way along each of the passages 32*a*, 32*b*, 32*c*, 32*d*, 32*e*. The fluid flows through the outgoing connecting pipes 46*b*, returns radially through the outgoing passage 42 and returns through the outer concentric passage 24.

At certain locations on the surface of the upper plate 30, thermocouples 52*a*, 52*b*, 52*c*, 52*d*, 52*e* are provided to correspond to the locations of each of the temperature adjustment passages 32*a*, 32*b*, 32*c*, 32*d*, 32*e*. Output cables from the thermocouples are connected to a control unit (CPU) 50 disposed in a center space in the third plate 38, in this case. This control unit 50 is operated by certain software, and generates a valve-control signal for each of the flow adjustment valves 48*a*, 48*b*, 48*c*, 48*d*, 48*e* in accordance with the output voltages from thermocouples 52*a*, 52*b*, 52*c*, 52*d*, 52*e*. In this example, the CPU is operated independently by an internal power source, but it may be controlled by an external controller by providing appropriate wiring circuitry. Flow adjustment valves 48*a*, 48*b*, 48*c*, 48*d*, 48*e* may be operated by electric motor or pressure air source.

In this embodiment, the upper two plates (upper plate 30 and second plate 34) of the plates 30, 34, 38 and 44 that comprise the polishing table 12 are made of a highly thermally conductive material such as SiC so as to improve the responsiveness of the polishing surface for thermal controlling. SiC has a thermal conductivity of 0.07 cal/cm/s/° C. which is about twice the value for stainless steels. It is not necessary for the third plate 38 and the lower plate 44 to have particularly high thermal conductivity, and, in fact, lower thermal conductivity of stainless steels is desirable to prevent temperature changes in the thermal medium flowing therethrough.

Figure 6:
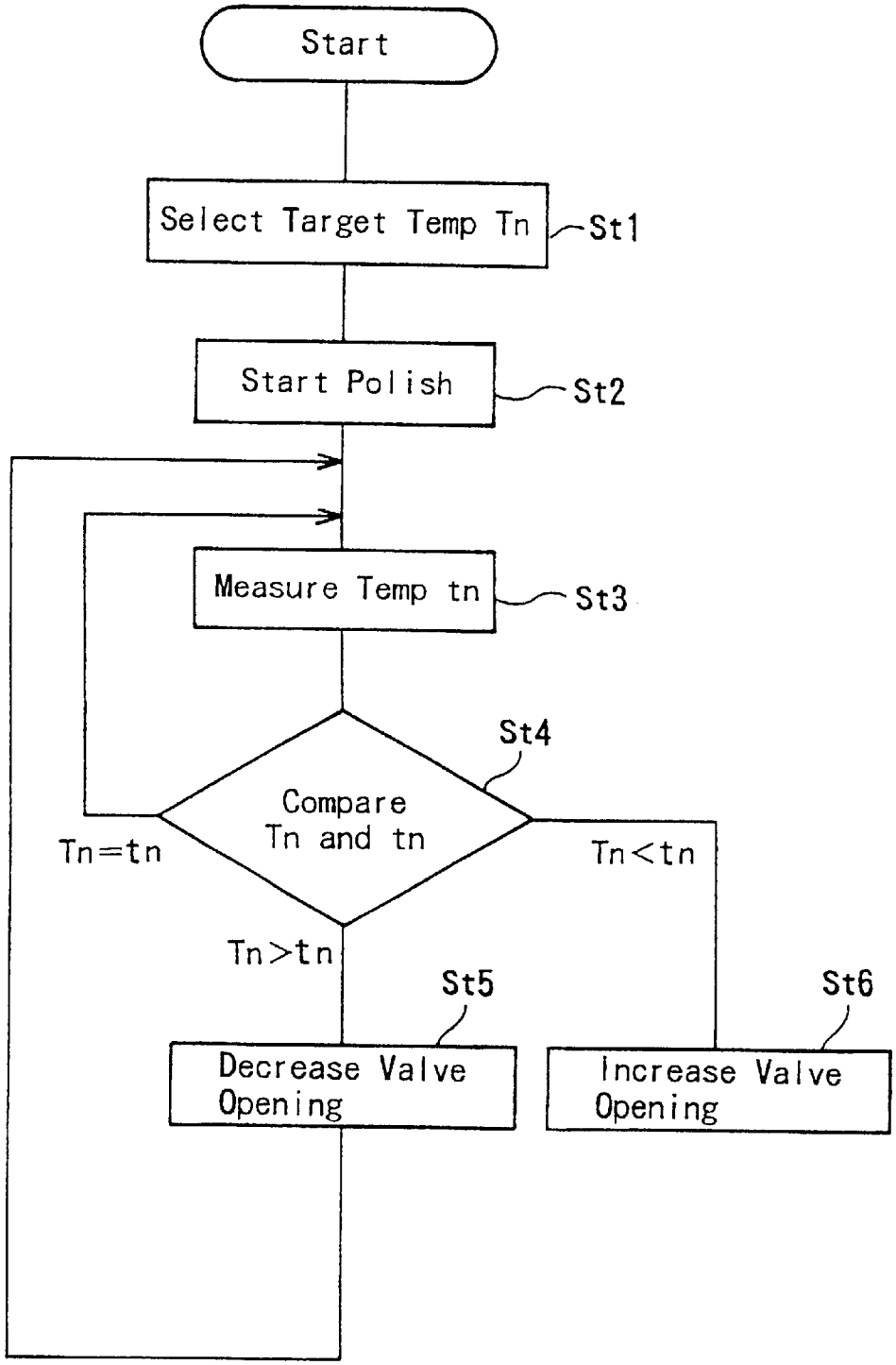
FIG. 6 is a flowchart for steps in a control process in a second embodiment.

The operation of the polishing apparatus of the construction presented above will be explained with reference to the flowchart shown in FIG. 6. A thermal medium is prepared by an external supply device so that the thermal medium (cooling water in this case) is at a desired temperature. Control unit 50 is pre-programmed with a target temperature $T_n$(n=a, b, . . . e) for each of the temperature adjustment passages 32*a*, 32*b*, 32*c*, 32*d*, 32*e* (S+1). Top ring 14 and the polishing table 12 are rotated respectively while supplying a polishing solution Q on the surface of the polishing cloth 10 through the solution nozzle 16, and the workpiece W held by the top ring 14 is pressed against the cloth 10 to perform polishing (S+2). Surface temperature of the workpiece W is altered in accordance with a thermal balance between heat generated by friction and heat removed by the polishing solution and others.

During polishing, temperature measurements are taken at certain intervals (S+3), and thermocouples 52*a*, 52*b*, 52*c*, 52*d*, 52*e* output respective temperature measurements $t_n$ to the control unit 50. Control unit 50 compares measured temperatures to with target temperatures $T_n$(S+4), and if $T_n=t_n$ (within an allowable deviation range), polishing is continued at the same settings and steps subsequent to S+3 are repeated. If $T_n>t_n$, flow rate is decreased by reducing the opening of the corresponding flow adjustment valve 48*n* (S+5), and if $T_n<t_n$ the opening of the flow adjustment valve 48*n* is increased (S+6), and the steps subsequent to S+3 are repeated to continue polishing.

Accordingly, in the polishing apparatus in this embodiment, the polishing table 12 is divided into a plurality of ring-shaped regions to form individual temperature adjustment passages 32*a*, 32*b*, 32*c*, 32*d* or 32*e* so as to enable adjusting the flow rates independently in respective passages. This configuration of the thermal regions enables a suitable response to changes in local polishing conditions of the polishing surf ace, so that a more uniform distribution of temperature can be obtained over the workpiece W by finely adjusting temperature in each region. Also, in this embodiment, because the upper plate 30 is made of SiC, which has a high thermally conductivity, results produced by flow rate changes can be reflected quickly in the surface temperature, thereby providing a thermally responsive apparatus.

Figure 7A:
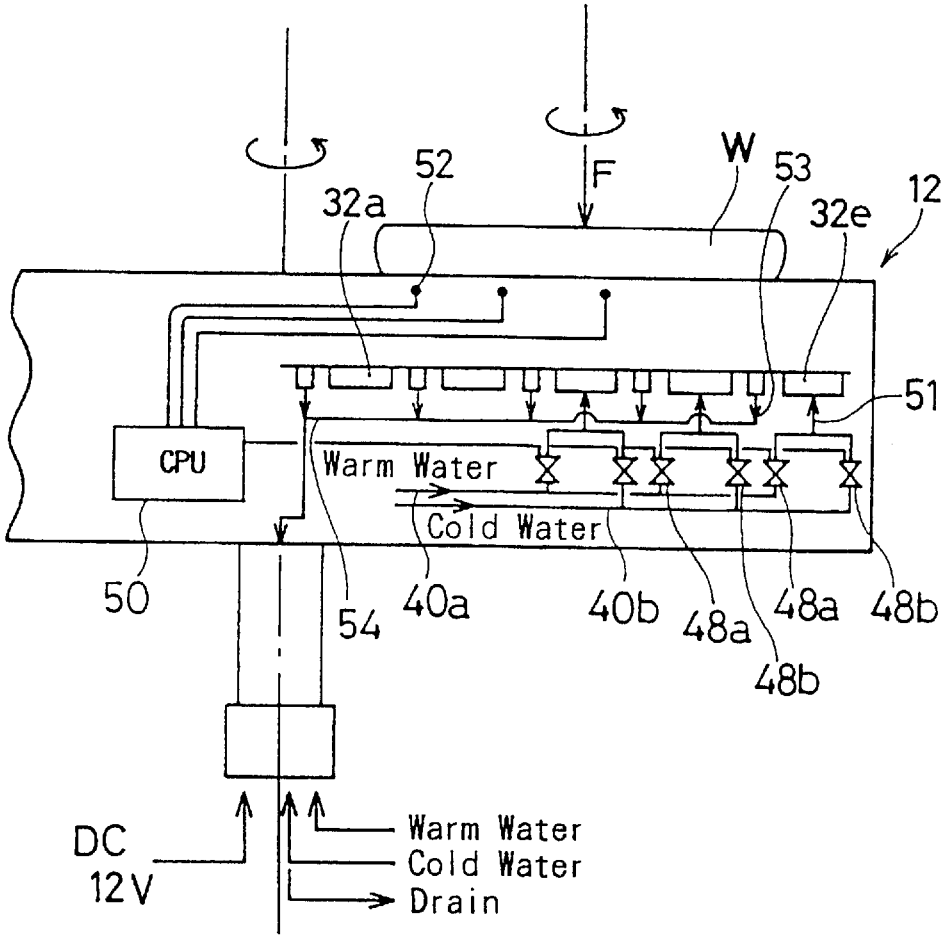
FIG. 7A is a schematic cross sectional view of a polishing table in the third embodiment.
Figure 7B:
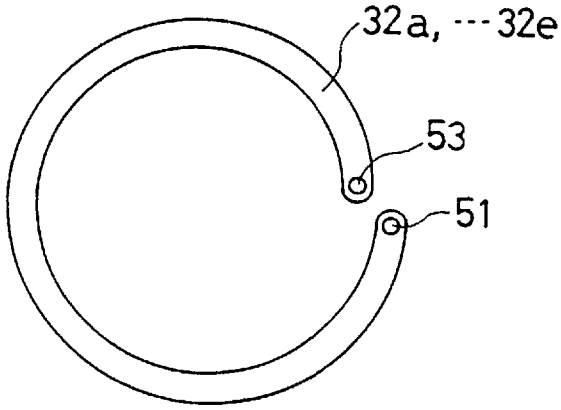
FIG. 7B is a schematic plan view of a temperature adjustment fluid passage shown in FIG. 7A.
Figure 8:
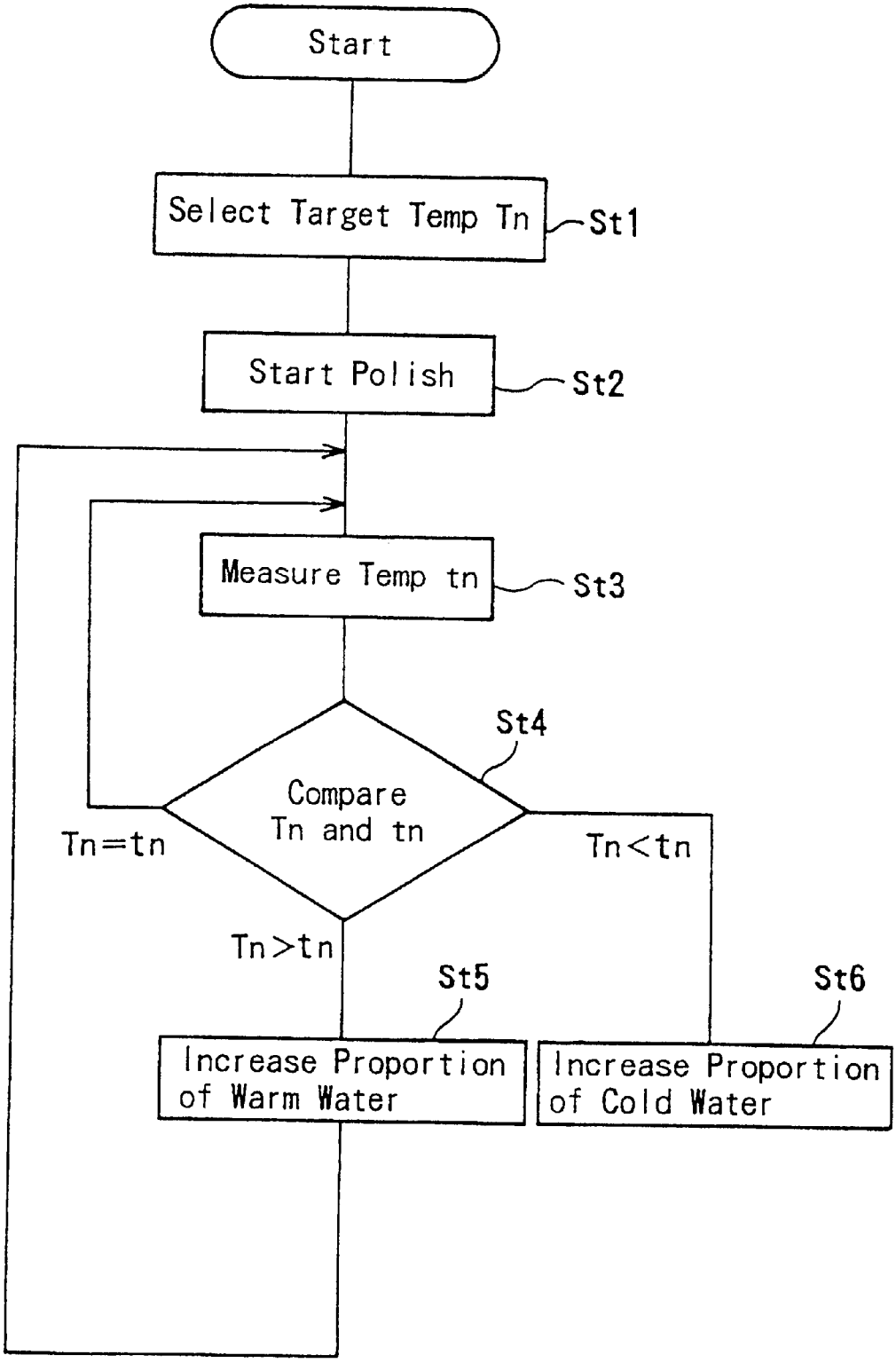
FIG. 8 is a flowchart for the steps in the control process in the third embodiment.
Figure 9:
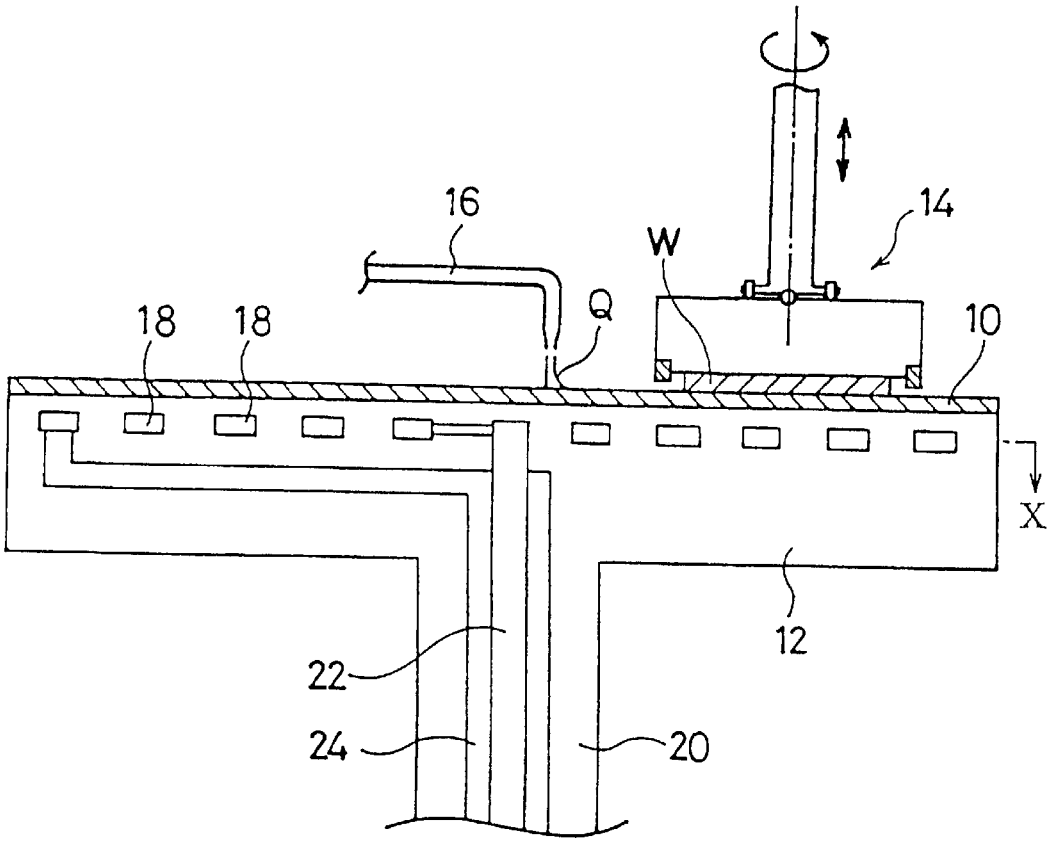
FIG. 9 is a cross sectional view of a conventional polishing table.
Figure 10:
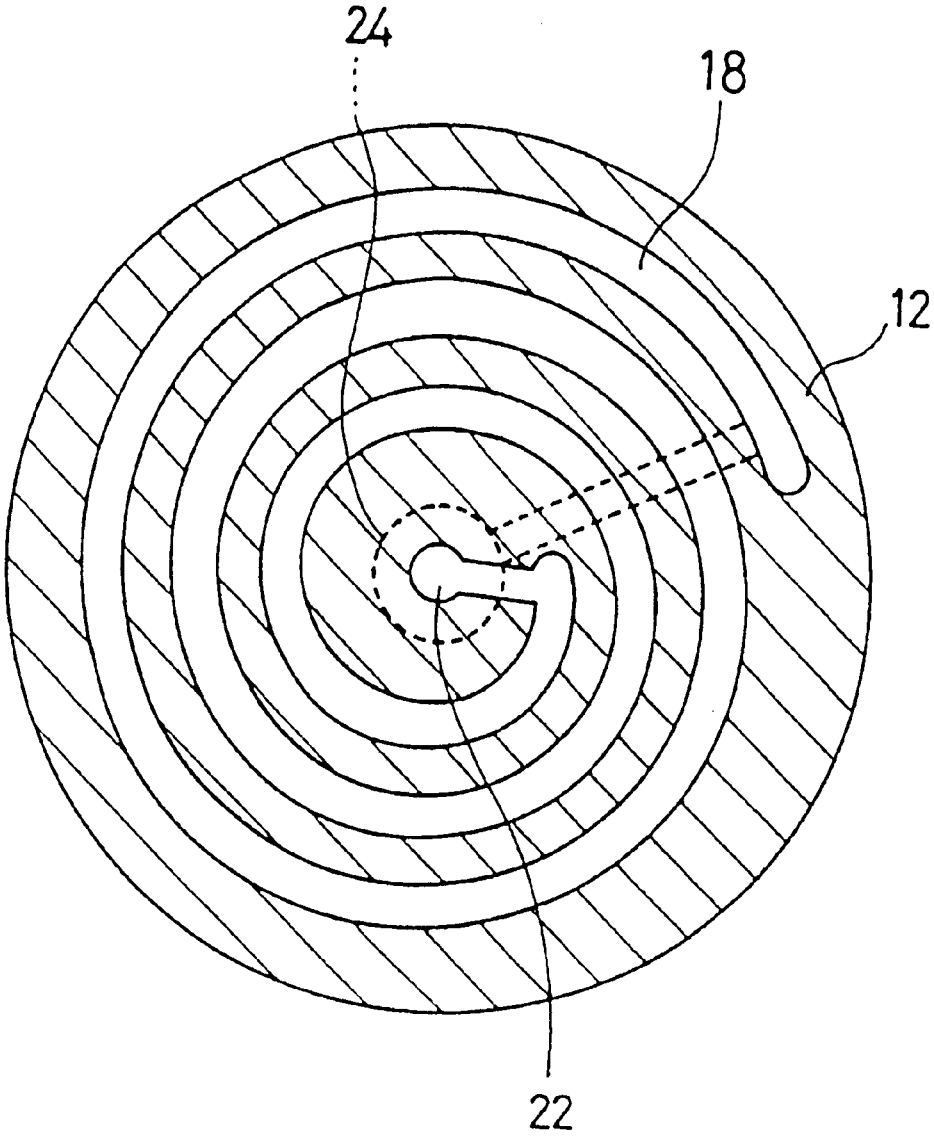
FIG. 10 is a perspective view through a section X in FIG. 9.

FIGS. 7A, 7B and 8 show other embodiments of the present invention. In this case, two thermal medium supply passages 40*a*, 40*b* are provided to direct two thermal media from external sources to the polishing table 12. Inlet ports of the individual temperature adjustment passages 32*a*, 32*b*, . . . 32*e* are communicated to thermal medium supply passages 40*a*, 40*b* through individual flow adjustment valves 48*a*, 48*b* and connecting passages 51. Outlet ports of the individual temperature adjustment passages 32*a*, 32*b*, . . . 32*e* are communicated to return passage 54 through individual connecting passages 53. Temperatures itself of thermal medium flowing into the passages 32*a*, 32*b*, . . . 32*e* are changed, in this case, by changing the mixing ratio of the two thermal media. Individual channel of the temperature adjustment passages is made as shown in FIG. 7B so that each passage is provided with an inlet port and an outlet port which are located at the ends of each of concentric severed rings and connected to respective incoming and outgoing connecting passages 51, 53. Two thermal medium passages 40*a*, 40*b* are separated by a thermally insulative structure.

Operational steps will be explained with reference to a flowchart shown in FIG. 8. The difference in control methodology from that in FIG. 6 is that the object of control in S+5 and S+6 in FIG. 6 is the flow rate of thermal medium while the object of control in FIG. 8 is the mixing ratio of a first thermal medium and a second thermal medium. In other words, when the measured temperature is less than the target temperature, the proportion of warm water is increased (S+5), and conversely, when the measured temperature is higher than the target temperature, the proportion of cold water is increased (S+6). It is permissible to adjust the flow rates of both media concurrently.

In this embodiment, because two thermal media of different temperatures are used, the rate of temperature change is increased compared with the previous embodiments, and therefore, highly responsive temperature control can be achieved. Also, the range of temperature control can be widened from a low temperature given by the cold water to a high temperature given by the warm water. In the examples given above, temperature was controlled to achieve a uniform distribution, but it is permissible to polish various regions of the workpiece at intentionally targeted individual temperatures.

In the above-described embodiments, the polishing table comprises a polishing cloth mounted on a surface plate of the turntable. However, it is also permissible to use a turntable having a grindstone mounted on the surface plate as a polishing tool. The grindstone is less susceptible to deformation, thereby being capable of providing a high flatness of the polished surface. In this case, the grindstone can be made of a high thermal conductivity material thereby to provide a high responsiveness for temperature control of the polishing table.

INDUSTRIAL APPLICABILITY

The present invention is useful as a polishing apparatus for providing a mirror polished surface on a workpiece in a manufacturing process of semiconductor wafer or liquid crystal display.

What is claimed is:

1. A polishing apparatus comprising:

a polishing table having one of a polishing section and a polishing tool attachment section at a surface of said polishing table and at least one thermal medium passage formed along said surface, wherein said at least one thermal medium passage comprises a plurality of temperature adjustment passages provided respectively in a plurality of temperature adjustment regions which are formed by dividing a surface area of said polishing table;

a workpiece holder adapted to hold and press a workpiece against said polishing table;

a plurality of sensors provided to correspond to locations of said plurality of temperature adjustment passages for measuring temperatures of said locations, respectively; and a temperature control unit operable to set a target temperature of each of said plurality of temperature adjustment passages and control a temperature of each of said plurality temperature adjustment passages according to a difference between the target temperature and a measured temperature of each of said locations.

2. A polishing apparatus according to claim 1, further comprising:

a plurality of flow adjustment valves adapted to individually control fluid flow rates of thermal media in said plurality of temperature adjustment passages, each of the fluid flow rates being controlled in accordance with a signal from said temperature control unit;

wherein the signal is generated in accordance with the difference between the target temperature and the measured temperature.

3. A polishing apparatus according to claim 1, wherein said plurality of sensors comprise thermocouples.

4. A polishing apparatus according to claim 1, wherein said at least one thermal medium passage comprises a plurality of thermal medium passages adapted to flow thermal media having different temperatures from each other.

5. A polishing apparatus according to claim 1, wherein said at least one thermal medium passage comprises a plurality of thermal medium passages each comprising two temperature adjustment passages extending from a fluid entry port disposed between a center and a periphery of said polishing table, and one of said two temperature adjustment passages extends to said center of said polishing table while the other of said two temperature adjustment passages extends to said periphery of said polishing table.

6. A method for controlling a temperature of a polishing table which has one of a polishing section and a polishing tool attachment section at a surface of the polishing table, and at least one thermal medium passage formed along the surface and comprising a plurality of temperature adjustment passages, said method comprising:

determining a reference temperature of each of the plurality of temperature adjustment passages, measuring a temperature of each of the plurality of temperature adjustment passages while polishing a workpiece;

comparing a measured temperature of each of the plurality of temperature adjustment passages with the reference temperature; and controlling a temperature of each of the plurality of temperature adjustment passages in accordance with a difference between the measured temperature and the reference temperature.

7. A method according to claim 6, herein the temperature of each of the plurality of temperature adjustment passages is controlled by controlling each of fluid flow rates of thermal media in the plurality of temperature adjustment passages.

8. A method according to claim 7, wherein each of the fluid flow rates is controlled in accordance with a signal from a temperature control unit, the signal being based on the difference between the measured temperature and the reference temperature.

9. A method according to claim 7, wherein temperature measurements of the plurality of temperature adjustment passages are taken at certain intervals.

10. A method according to claim 6, wherein thermal media in the plurality of temperature adjustment passages comprise fluids having at least two different temperatures, and the temperature of each of the plurality of temperature adjustment passages is controlled by adjusting a mixing ratio of the fluids having the at least two different temperatures.

* * * * *